United States Patent [19]

Kresse et al.

[11] Patent Number: 4,850,075

[45] Date of Patent: Jul. 25, 1989

[54] MANUAL SURFACE WIPER ASSEMBLY WITH HANDLE AND SUPPORT THEREFOR

[75] Inventors: Franz Kresse, Hilden; Bernfrid Scheller, Pulheim, both of Fed. Rep. of Germany

[73] Assignee: Henkel Kommanditgesellschaft auf Aktien, Duessldorf, Fed. Rep. of Germany

[21] Appl. No.: 217,578

[22] Filed: Jul. 11, 1988

[30] Foreign Application Priority Data

Jul. 11, 1987 [DE] Fed. Rep. of Germany ..... 3722960

[51] Int. Cl.[4] ..... A47L 13/20

[52] U.S. Cl. ..... 15/228; 15/143 R; 15/144 R; 15/147 R; 15/229.6; 248/359 H

[58] Field of Search ..... 15/143 R, 144 R, 144 A, 15/144 B, 147 R, 147 D, 148, 149, 159 R, 228, 229.1, 229.6–229.9; 211/65; 248/359 R, 359 E, 359 H, 360

[56] References Cited

U.S. PATENT DOCUMENTS

| | | | |
|---|---|---|---|
| 690,803 | 1/1902 | Whitehead | 248/359 H |
| 1,943,479 | 1/1934 | Hesson | 15/144 R |
| 3,132,834 | 5/1964 | Adams | 15/143 R X |
| 3,188,671 | 6/1965 | Kane | 15/147 R |

*Primary Examiner*—Edward L. Roberts
*Attorney, Agent, or Firm*—Ernie G. Szoke; Wayne C. Jaeschke; Real J. Grandmaison

[57] ABSTRACT

A self-standing manual surface-treating wiper assembly comprising a floor-engaging wiper head and an elongate handle pivotally-attached thereto at a central location for vertical extension to enable manual movement of the wiper head over a surface to be treated. A short swivel leg is pivotally-attached near the base of the handle for engagement with a detent on the wiper head to enable the handle to be supported upright and render the wiper assembly self-standing during periods of non-use.

9 Claims, 1 Drawing Sheet

MANUAL SURFACE WIPER ASSEMBLY WITH HANDLE AND SUPPORT THEREFOR

BACKGROUND OF THE INVENTION

1. Field of the Invention

This invention relates to a self-standing surface wiper assembly having an elongate handle pivotally mounted centrally on a wiper head having a relatively large surface area.

2. Statement of the Prior Art

Manual floor wipers, including mops, are being used to an increasing extent for moist, semi-wet, and wet wiping of large surfaces, for the disinfecting and cleaning of floors in hospitals and other institutions and homes, and for applying liquids, including emulsions, to floors and other large surfaces.

Handled wiping devices often have to be put aside during the wiping procedure because of work-related or other interruptions. Thus, in the application of emulsions including floor waxes, the emulsion generally is poured manually onto the floor in portions from a large container, which may be a 10 liter can, and is then spread section-by-section using the wiper. However, the wiper must be put aside each time more emulsion is poured on. To this end, the wiper may be laid full length horizontally on the floor, i.e., including the elongate handle. However, this is very laborious because, with every interruption in wiping, the user has to bend to put down the wiper and has to bend again to pick it up to resume the wiping operation. In addition, the wiper lying around on the floor increases the danger of stumbling and hence accidents.

The wiper can also be put aside in the upright position, by leaning the handle against a wall or other vertical surface. This requires the user to travel back and forth unproductively at frequent intervals, particularly where the rooms being cleaned or otherwise treated are large. In addition, leaning the wiper handle against a smooth vertical wall provides an extremely unstable support because a universal type joint generally connects the wiper head to the handle on most manual wiping devices. In such cases, under the effect of gravity, the handle can pivot not only in the direction in which it is attached, but also sideways, so that, unless it is supported absolutely straight the handle can tilt and fall to the ground.

Accordingly, it is an object of the present invention to provide a floor wiper which can be set aside or temporarily stored in an upright position safely and conveniently, and without the need for additional vertical support.

DESCRIPTION OF THE INVENTION

Figure 1:
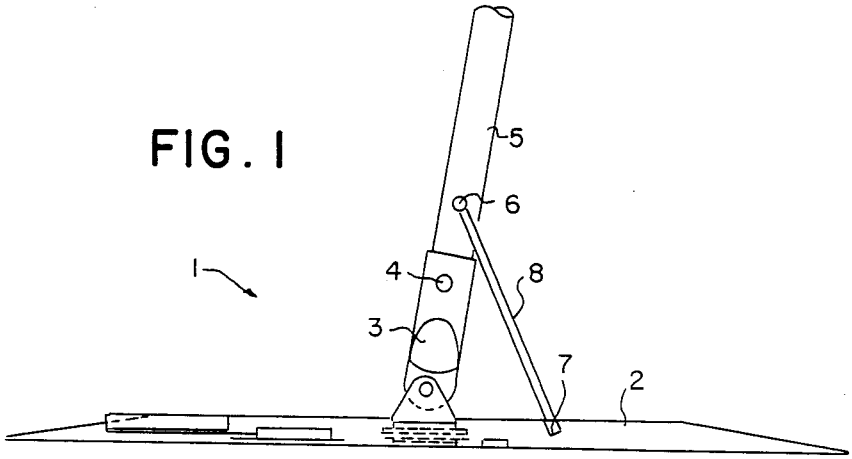
FIG. 1 is a diagrammatic side elevation of a manual floor wiper having a pivotally-attached handle and a built-in stand, according to a preferred embodiment of the present invention.
Figure 1:
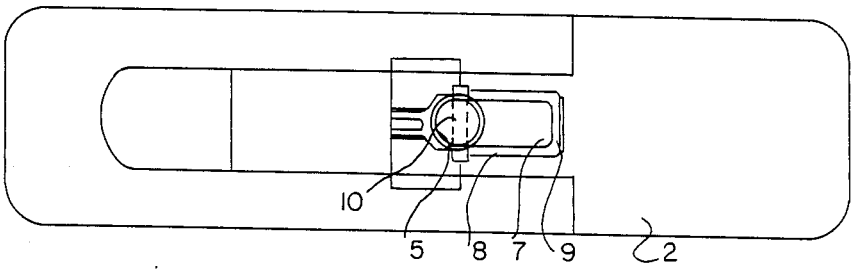

The objects and advantages of the present invention are accomplished by the provision of a manual floor wiper comprising a flat, relatively large floor-engaging head, including a mop or pad, the upper surface of which comprises a socket attachment means for pivotally-attaching the socket of an elongate handle to the wiper head at a central location thereof, and also comprises a detent means for releasably receiving and holding the base of a support means or short swivel leg which is pivotally attached to the handle at a location spaced above the socket attachment means.

According to a preferred embodiment of the invention, the handle of a manual surface wiper is provided with a stand or swivel leg in the form of a U-shaped stirrup mounted on the handle, directly above the socket attachment means on the head, supported by a pin through a horizontal bore extending through the handle in a transverse direction, i.e., a direction offset by 90° from the longitudinal axis of the wiper head, so that the base or cross leg of the U part of the stirrup is engaged by the detent on the upper surface of the wiper head, the upper ends of the legs of the U part of the stirrup being pivotally supported by the pin on the handle at a distance above the socket attachment means and wiper head.

The present manual wiper is self-standing so that it can be set aside or stood on a horizontal surface with its handle in a substantially upright position, without any additional vertical support, since the surface area of the wiper head and the base of the stand are large enough to support the weight of the handle against tipping of the wiper assembly in all directions. This is accomplished by deflecting the handle from the vertical position to pivot and slide the elongate cross leg or base of the U-shaped swivel leg or stand over the upper surface of the wiper head until it is engaged within the supporting detent. The base of the swivel leg rests horizontally in the detent and is long enough in the transverse direction to support the handle of the wiper assembly against tipping in any direction.

According to one particularly advantageous embodiment of the invention, the detent or supporting surface is in the form of an elongate recess in the upper surface of the wiper head, extends transversely of the longitudinal axis of the wiper head and has a width which corresponds to the diameter of the base or cross leg of the swivel leg of the stirrup so that the base or cross leg is able to engage within the recess. Thus, the base of the swivel leg of the stirrup or stand is not only able to lean on the supporting surface, but also engages within the recess to provide a firm connection. To release this standing connection, the handle is brought back from the slightly inclined vertical position into its true vertical position to cause the stirrup or swivel leg to slip out of the recess in simple fashion so that the wiper assembly is ready to be used again.

According to another embodiment of the invention, the pin which hingedly supports and connects the U-shaped swivel leg or stirrup to the handle is designed to be mounted in a transverse bore in a socket extension of the elongate handle. In this embodiment, the pin also serves as a connecting element between the socket extension, which is a part of the handle, and a removable elongate handle stick.

It will be understood that different materials may be used for the U-shaped stirrup, swivel leg or stand, including round or tubular steel, rectangular flat steel, high-impact plastics materials and similar materials.

DETAILED DESCRIPTION OF THE DRAWING

Figure 2:
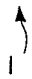
FIG. 2 is a plan view of the wiper of FIG. 1.

FIGS. 1 and 2 of the accompanying drawing illustrate a floor wiper assembly 1 which consists of a wiper head 2 having a large surface area, a centrally arranged pivotally-mounted handle socket 3 formed with a transverse horizontal bore 4, and an elongate handle extension 5 with a horizontal transverse bore 6 in a direction offset through 90° from the longitudinal axis of the wiper head 2. The floor wiper assembly 1 additionally comprises, on the upper surface of the wiper head 2, a detent or recess 7 extending transversely of the longitudinally axis of the wiper head 2, and a U-shaped stand, swivel leg or stirrup 8 with an elongate, horizontal base or cross leg 9, and a horizontal pin 10 which extends through the upper ends or legs of the U-shaped stand 8 and through the handle bore 6 to hingedly attach the stand 8 to the handle 5 through the handle bore 6.

The assembly functions in the following manner:

During use, the wiper handle 5 is in a more vertical position or is inclined slightly from vertical in a direction opposite to that illustrated by FIG. 1. In this position, the cross leg 9 of the U-shaped stirrup 8 rests on the upper surface of the wiper head 2 between the handle socket 3 and the detent or recess 7. To set the floor wiper 1 aside or stand it unattended, the handle 5 is pivoted or inclined from the vertical, in the direction of the recess 7, to cause the cross leg 9 of the U-shaped stirrup 8 to slide on the upper surface of the wiper head 2 towards the recess 7. When the handle 5 has been deflected far enough, the cross leg 9 reaches the recess 7 and engages therein. As a result, the handle 5 remains supported upright on the large-surface wiper head 2 and the wiper 1 can be left unattended as a self-supporting assembly in a convenient location ready for reuse. The transverse width of the wiper head 2 and the transverse width of the cross leg 9 are also sufficient to support the weight of the handle against tipping of the wiper assembly 1 in the sideways directions. When the floor wiper assembly 1 is to be used again, the handle 5 simply is moved back from its inclined position into the true vertical position so that the cross leg 9 of the stand slides out of the recess 7 and the floor wiper 1 is ready to be used again.

The invention is not confined to the specific embodiment shown in the drawing. Thus, other similar designs and structures will be apparent to those skilled in the art within the basic scope of the invention, i.e., instead of the recess in the surface of the wiper, it is also possible to provide a correspondingly shaped elevated bridge.

It is to be understood that the above described embodiments of the invention are illustrative only and that modifications throughout may occur to those skilled in the art.

We claim:

1. A self-standing manual surface wiper assembly comprising a wiper head having an upper surface and a lower floor-engaging surface, a handle comprising socket means pivotally attached to socket-attachment means at a central location on the upper surface of the wiper head, an elongate handle extending from said socket means for adjustable vertical extension above said wiper head, and cooperating stand means on the upper surface of the wiper head and on a portion of said handle spaced above the socket-attachment means providing a prop member against which said elongate handle can be leaned and balanced in substantially vertical extension from said wiper head while the lower surface of said head is in engagement with a horizontal floor.

2. A surface wiper assembly according to claim 1 in which said cooperating stand means comprise a swivel leg hingedly attached to said handle, and a detent means on the upper surface of the wiper head for engaging the base of the swivel leg to provide said prop member.

3. A surface wiper assembly according to claim 2 in which said swivel leg has an elongate horizontal base extending in a direction transverse to the longitudinal axis of said wiper head, and said detent means comprises an elongate horizontal recess for receiving said horizontal base to support said handle and wiper assembly against tipping in said transverse direction.

4. A surface wiper assembly according to claim 3 in which said swivel leg is a U-shaped member comprising opposed extension legs and a lower connecting cross leg forming said horizontal base, the upper ends of said extension legs being hingedly attached to said handle.

5. A surface wiper assembly according to claim 4 in which said handle comprises a swivel leg supporting horizontal bore extending in said transverse direction, and the upper ends of said extension legs are engaged on opposite sides of said handle by a pivot pin which is supported within said horizontal bore.

6. A surface wiper assembly according to claim 4 in which said U-shaped member is formed of tubular metal.

7. A surface wiper assembly according to claim 4 in which said U-shaped member is formed of rectangular flat steel.

8. A surface wiper assembly according to claim 4 in which said U-shaped member is formed of high-impact plastic.

9. A surface wiper assembly according to claim 1 in which said elongate handle comprises an extension which is releaseably-attached to said socket means.

* * * * *

Disclaimer 4,850,075.—*Franz Kresse*, Hilden; *Bernfrid Scheller*, Pulheim, both of the Fed. Rep. of Germany. MANUAL SURFACE WIPER ASSEMBLY WITH HANDLE AND SUPPORT THEREFOR. Patent dated Jul. 25, 1989. Disclaimer filed Dec. 21, 1989, by the assignee, Henkel Kommanditgesellschaft auf Aktien.

Hereby enters this disclaimer to claims 1, 2 and 9 of said patent.

[ *Official Gazette May 29, 1990* ]